US006337451B1

(12) United States Patent
De Leo

(10) Patent No.: US 6,337,451 B1
(45) Date of Patent: Jan. 8, 2002

(54) PLANNING PROCEDURE FOR CLEARING MAIL SORTING MACHINE OUTPUTS CONCURRENTLY WITH A MAIL SORTING PROCESS

(75) Inventor: Guido De Leo, Genoa (IT)

(73) Assignee: Elsag SpA, Genoa (IT)

( * ) Notice: Subject to any disclaimer, the term of this patent is extended or adjusted under 35 U.S.C. 154(b) by 0 days.

(21) Appl. No.: 09/373,974

(22) Filed: Aug. 16, 1999

(30) Foreign Application Priority Data

Aug. 14, 1998 (IT) ..... TO98A0713

(51) Int. Cl.[7] ..... B07C 5/00

(52) U.S. Cl. ..... 209/584; 209/900; 271/3.14; 271/4.01

(58) Field of Search ..... 209/583, 584, 209/900; 271/3.14, 7, 4.01

(56) References Cited

U.S. PATENT DOCUMENTS 5,518,122 A 5/1996 Tilles et al. ..... 209/584 X
5,901,855 A * 5/1999 Uno et al. ..... 209/584
5,954,207 A * 9/1999 Yamashita et al. ..... 209/900 X

FOREIGN PATENT DOCUMENTS

| | | |
|---|---|---|
| DE | 196 29 125 | 1/1998 |
| EP | 0 812 629 | 12/1997 |
| EP | 0 827 786 | 3/1998 |

* cited by examiner

*Primary Examiner*—Tuan N. Nguyen
(74) *Attorney, Agent, or Firm*—Venable; George H. Spencer; Robert Kinberg

(57) ABSTRACT

A method for clearing outputs of a mail sorting machine concurrently with a current sorting cycle of a mail sorting process is disclosed. At each sorting cycle, each output of the sorting machine is assigned a number of respective delivery locations of the mail items. An indication of the time intervals when the outputs are available or unavailable, is represented by a matrix. Each element in the matrix is assigned a delivery location; and the column and row of each element represents the outputs occupied, by the mail items bearing the delivery location assigned to the box, at the end of the current sorting cycle and the logically preceding sorting cycle respectively. The method provides for defining non-addressable elements to which delivery locations cannot be assigned, so that the outputs may be cleared by a clearing resource at that time.

30 Claims, 7 Drawing Sheets

1
22
16
$U_n$
6
I
T
T
T
T
10
12
14
6
6
2
F
2
4
$U_1$
$U_2$

PLANNING PROCEDURE FOR CLEARING MAIL SORTING MACHINE OUTPUTS CONCURRENTLY WITH A MAIL SORTING PROCESS

The present invention relates to a planning procedure for clearing mail sorting machine outputs concurrently with a mail sorting process.

BACKGROUND OF THE INVENTION

Mail sorting machines are known which receive at the input a stream of randomly arranged mail items, and produce at the output a sequenced stream of mail items, i.e. arranged in a predetermined progressive order enabling sequential distribution by one or more mailmen assigned to a given route.

More specifically, known mail sorting machines normally comprise an input (also said induction) receiving a mail batch, i.e. a set of mail items for sorting; a number of outputs, which may be assigned respective containers into which respective groups of mail items are fed; and a sorting device interposed between the input and outputs of the machine and controlled by an electronic processing unit to direct each mail item to a respective output on the basis of a code, normally printed on the mail item, and a table relating the code to a given machine output.

The progressive order in which the mail items in each batch are arranged at the machine outputs may be defined, for example, by a sequence of adjacent delivery locations or destinations corresponding to building numbers or groups of building numbers along the delivery route of the mail items in the batch.

Each mailman responsible for delivering the mail items in the batch is assigned a specific respective group of machine outputs, from which, at the end of the sorting process, the mail items are withdrawn and handed over for delivery.

The sorting process performed by a mail sorting machine on a given mail batch typically comprises a number of consecutive sorting cycles whereby groups of mail items are fed repeatedly through the machine and directed to outputs associated with containers from which the mail items deposited in the previous sorting cycle have been removed.

By the end of the sorting cycles, the mail items coming off the machine are arranged in groups in a predetermined progressive order enabling sequential distribution by a mailman assigned to a subsection of a given route.

Mail sorting machines of the above type are normally capable of different mail processing modes.

In particular, the machine may perform in chronologically consecutive order all the sorting cycles of a sorting process relating to the same mail batch; may perform in chronologically consecutive order a number of same-sequence-position sorting cycles—e.g. a number of second sorting cycles—of sorting processes relating to different mail batches; or may perform a number of different-sequence-position sorting cycles of sorting processes relating to different mail batches.

A drawback common to all known sorting processes is the possibility of one or more outputs on the machine filling up in the course of a sorting cycle, in which case, the relative sorting process cannot be continued while the output is being cleared.

In particular, if other than occasional, fill-up of the outputs in the course of a sorting cycle other than the first severely impairs efficiency by inevitably requiring interruption of the current sorting cycle to clear the output, thus resulting in considerable downtime due not only to the interruption in the sorting cycle but also to the numerous precautions which must be taken as regards processing of the mail items before the sorting process can be re-started.

Nor is anything to be gained by overlapping the sorting and clearing operations when switching from one cycle to another involving the same set of outputs, in that, failing stoppage of the system or routing artifices, which can only be employed in very limited cases, the mail items not accommodated in the output being cleared would fall out of sequence, thus resulting in rejection and the need for additional processing to reestablish the correct sequence.

SUMMARY OF THE INVENTION

It is an object of the present invention to provide a planning procedure for clearing mail sorting machine outputs concurrently with a mail sorting process, designed to eliminate the aforementioned drawbacks.

According to the present invention, there is provided a planning procedure for clearing mail sorting machine outputs concurrently with a current sorting cycle of a mail sorting process comprising a first and at least a second logically consecutive sorting cycle; said current sorting cycle being performed by a mail sorting machine receiving a batch of mail items at the input and supplying said mail items, identified and separated according to given sorting rules, at outputs of the mail sorting machine; in one sorting cycle, the mail items being fed to the outputs of the mail sorting machine on the basis of a respective predetermined sorting criterion, and being fed in orderly manner back to the input of the mail sorting machine to perform a successive sorting cycle; each output of the mail sorting machine being assigned, at each sorting cycle, a number of respective delivery locations to which the mail items are to be delivered; the operating state of the outputs of the mail sorting machine in the current sorting cycle and in the logically preceding sorting cycle, and indicating the time intervals in which the outputs are available or unavailable for sorting mail items, being represented by a matrix in which each column represents the operating state of a respective output of the mail sorting machine in the current sorting cycle, and each row represents the operating state of a respective output of the mail sorting machine in the logically preceding sorting cycle; each box in the matrix being assigned a respective said delivery location; and the column and the row of each box representing the outputs of the mail sorting machine occupied, by the mail items bearing the delivery location assigned to said box, at the end of the current sorting cycle and the logically preceding sorting cycle respectively; said planning procedure being characterized by comprising the step of defining, in said matrix, non-addressable boxes to which delivery locations cannot be assigned, so that the current sorting cycle contains time intervals in which no mail items are fed into the outputs of the mail sorting machine corresponding to the columns containing said non-addressable boxes, and said outputs may therefore be cleared by a clearing resource during said time intervals.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
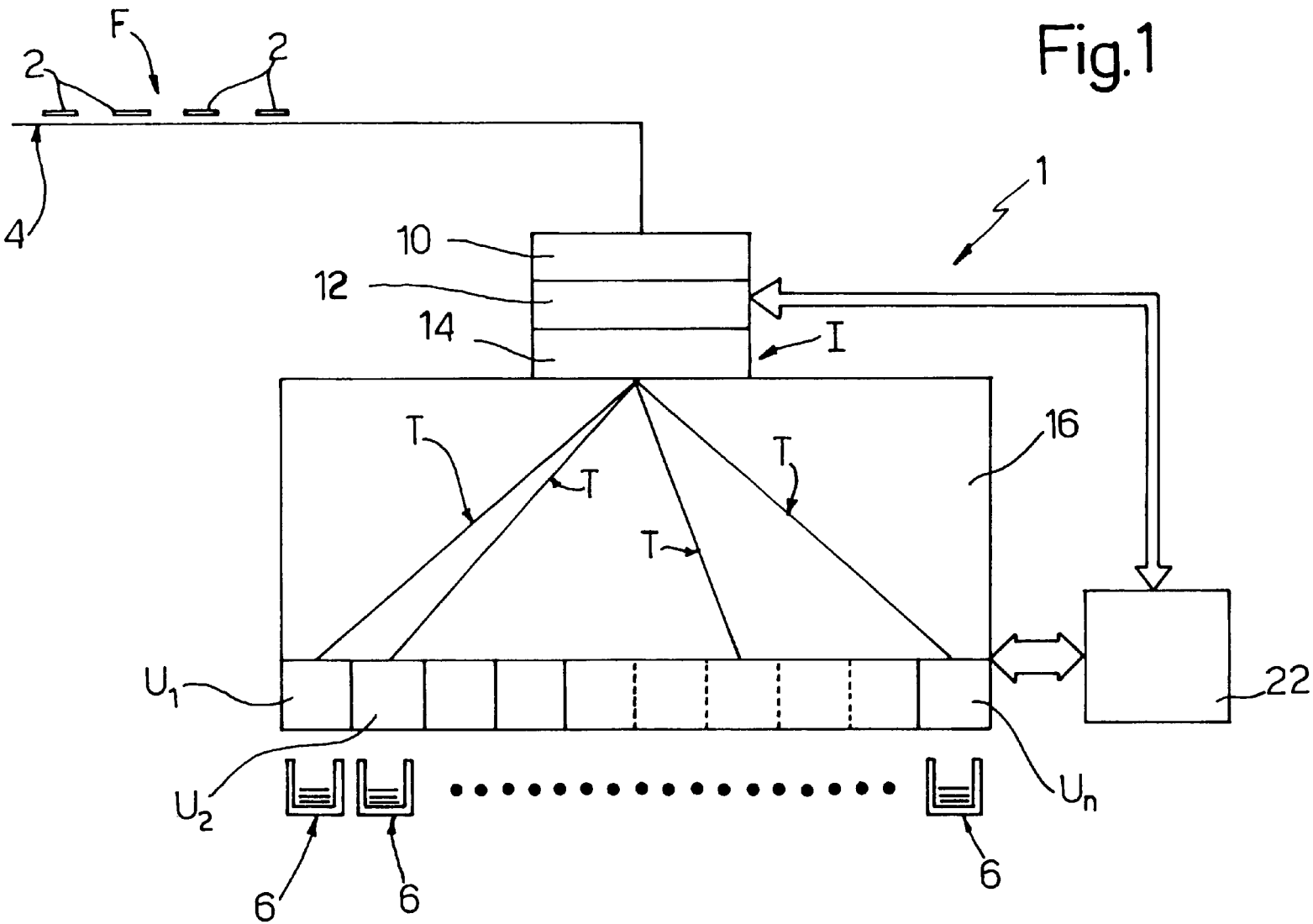
FIG. 1 shows, schematically, a mail sorting machine.

Number 1 in FIG. 1 indicates as a whole a mail sorting machine comprising an input I for receiving a stream F of mail items 2 (e.g. letters, postcards, enveloped items, or flat, substantially rectangular items in general) arranged in sequence (e.g. stacked) and fed to input I on a known conveying device (e.g. belt conveyor) 4; and a number (N) of separate outputs U1, U2, U3, . . . , UN, each of which may conveniently be assigned a pull-out container 6 (shown schematically) in and from which the incoming items 2 are stacked and removed.

Stream F of items 2 comprises a number of items 2, each impressed beforehand with a code, e.g. a bar code, indicating the delivery location or destination of item 2. Items 2 are arranged in a "disorderly", i.e. random, sequence bearing no relation to the progressive order in which items 2 are later to be distributed.

At input I, sorting machine 1 comprises a separating device 10 (shown schematically) which receives items 2 from conveying device 4, extracts items 2 from stream F, and spaces each item 2 apart from the others in stream F; a reading device 12 (shown schematically) which receives items 2 from separating device 10 and reads the code on each item 2; a delay module 14 (shown schematically) which receives items 2 from reading device 12; and a sorting device 16 inside sorting machine 1 and interposed between the output of delay module 1; and outputs U1, U2, U3, . . . , UN.

Sorting machine 1 is controlled by a programmable electronic unit 22, by means of which, sorting device 16 directs the incoming stream F at input I to all N outputs of sorting machine 1, i.e. operates in common sorting mode whereby each item 2 fed to input I may be fed to any one of the N outputs.

The route of each item through sorting device 16, i.e. the path T along which each item 2 travels through sorting device 16 from input I to a generic output Ui, is determined by the code read by reading device 12 on item 2.

For which purpose, electronic unit 22 comprises an electronic table, which receives, e.g. from reading device 12, the data relating to the code on each item 2, and supplies a set of output data identifying the output Ui to which item 2 is to be directed.

The output data is then transmitted to sorting machine 1 to generate signals by which to control actuating members, e.g. blade selectors, transmission members, etc. (not shown), for defining the path T along which item 2 is directed through sorting device 16 to the selected output Ui.

The planning procedure according to the present invention will now be described with reference to a mail sorting machine 1 comprising one input and fifty outputs, though purely by way of example, in that the inventive principle underlying the planning procedure according to the invention may be applied, with no alterations, to a mail sorting machine having more than one input and/or any number of outputs.

The planning procedure for clearing the outputs of mail sorting machine 1 will also be described with reference to a generic sorting cycle following a first sorting cycle.

As is known, in the first sorting cycle of a sorting process, the mail items are fed to input I of sorting machine 1 and then directed to outputs U of sorting machine 1 on the basis of a first given sorting criterion. The mail items are then extracted in orderly manner from outputs U and fed back into sorting machine 1 through input I in a predetermined reinsertion order to perform a second sorting cycle, in which the mail items are directed to outputs U on the basis of a second given sorting criterion, are extracted from outputs U, and are then either distributed, for example, for actual delivery, if the sorting process only comprises two sorting cycles, or are fed back into sorting machine 1 through input I to perform a third sorting cycle, and so on.

Consequently, if the sorting machine performs in chronologically consecutive order all the sorting cycles of a sorting process relating to the same mail batch, the sorting cycle considered in the description is one following a sorting cycle of the same sorting process. On the other hand, if sorting machine 1 performs in chronologically consecutive order a number of same-sequence-position sorting cycles of sorting processes relating to different mail batches, or performs in chronologically consecutive order a number of different-sequence-position sorting cycles of sorting processes relating to different mail batches, the sorting cycle considered is performed, in the first case, after a same-sequence-position sorting cycle of a different sorting process, or, in the second case, after any sorting cycle of a different sorting process relating to a different mail batch.

The planning procedure will also be described with reference to the FIG. 2 matrix, which, as explained in the following description, shows utilization of outputs U of sorting machine 1 at the end of the sorting cycle considered and the previous sorting cycle of a sorting process relating to the same mail batch.

Figure 2:
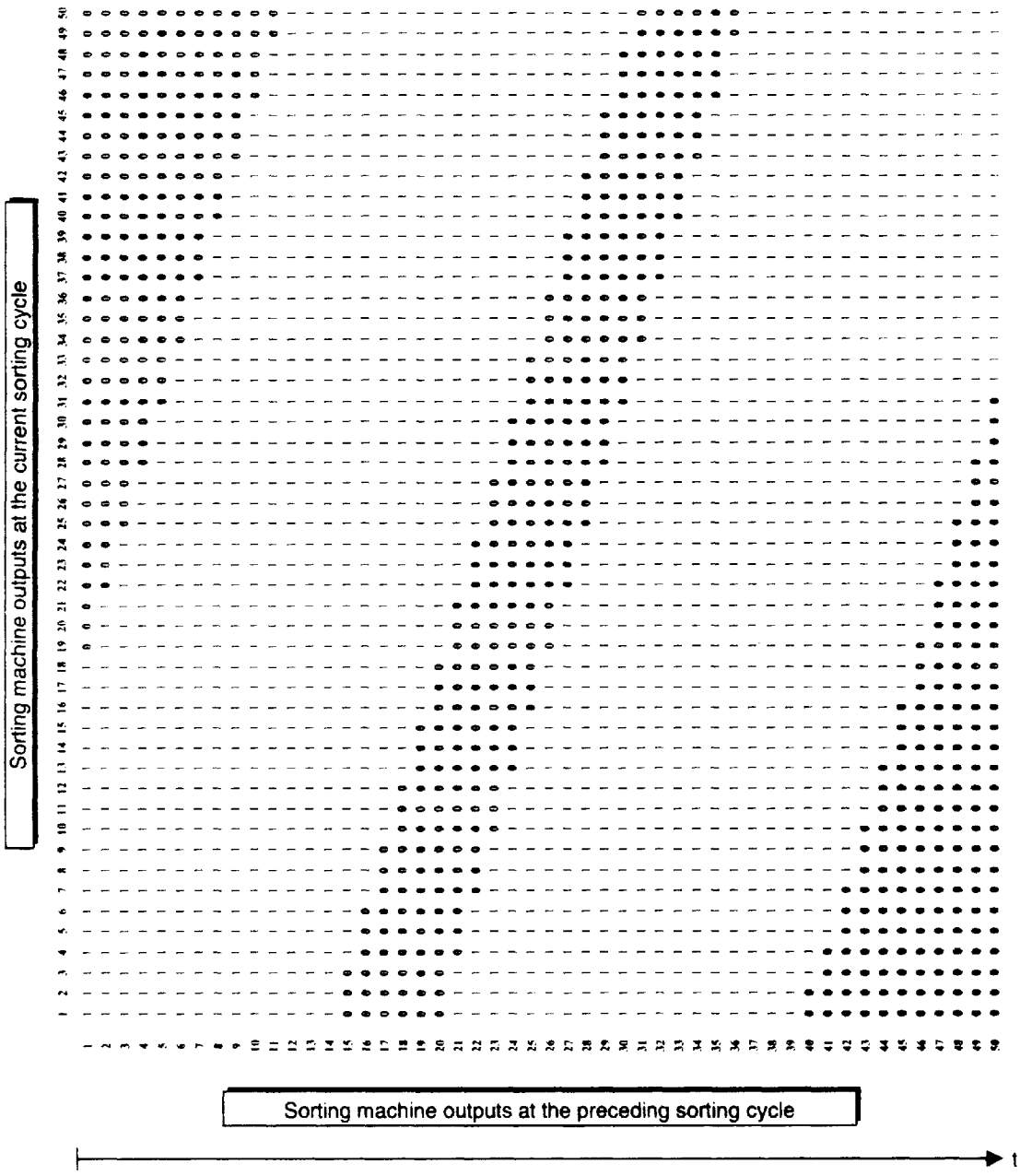
FIGS. 2 and 3 show a matrix illustrating utilization of the outputs of a mail sorting machine in the course of two generic successive sorting cycles.

What is stated above concerning the FIG. 2 matrix representation applies not only when sorting machine 1 performs in chronologically consecutive order all the sorting cycles of a sorting process relating to the same mail batch, but also when the sorting cycle considered is performed after a same-sequence-position sorting cycle of a sorting process relating to a different mail batch, or after any sorting cycle of a sorting process relating to a different mail batch.

Consequently, even when sorting machine 1 performs sorting cycles of other sorting processes between the sorting cycle considered and the previous sorting cycle of the same sorting process, the FIG. 2 matrix nevertheless still shows utilization of outputs U of sorting machine 1 at the end of the sorting cycle considered and the previous sorting cycle of the sorting process relating to the same mail batch, and is in no way related to the sorting cycle performed immediately prior to the sorting cycle considered.

In the following description, the generic sorting cycle considered is referred to as the "current sorting cycle"; the sorting cycle preceding the current sorting cycle of a sorting process relating to the same mail batch as the current sorting cycle is referred to as the "logically preceding sorting cycle"; and the sorting cycle performed by sorting machine 1 immediately prior to the current sorting cycle is referred to as the "chronologically preceding sorting cycle". When sorting machine 1 performs in chronologically consecutive order all the sorting cycles of a sorting process relating to the same mail batch, the chronologically preceding sorting cycle therefore coincides with the logically preceding sorting cycle.

As shown in FIG. 2, the matrix comprises fifty rows and fifty columns indicated by respective progressive identification numbers. In particular, the column identification numbers are arranged in ascending order from left to right, and the row identification numbers in ascending order downwards.

As explained more clearly later on, each column in the matrix also indicates the operating state of a respective output U of sorting machine 1 in the current sorting cycle, the term "operating state" being intended to mean the time intervals in which an output is available for sorting mail items, or is unavailable for sorting by reason of being programmed for clearing.

Given the relationship between the rows and columns in the matrix and the outputs of sorting machine 1 in the current sorting cycle and logically preceding sorting cycle, each row and each column identification number in the FIG. 2 matrix also identifies a respective output U of sorting machine 1 at the end of the current sorting cycle and the logically preceding sorting cycle.

The actual physical position of the outputs of sorting machine 1, however, does not necessarily correspond to the progressive row and column numbers in the FIG. 2 matrix, i.e. the outputs of sorting machine 1 are not necessarily arranged in ascending order corresponding to that of the row and column identification numbers.

In other words, the output of sorting machine 1 represented by column "1" need not actually be the first output of sorting machine 1; and the output represented by column "2"—which, in the matrix, is adjacent to and follows the first column—need not actually be the second output of sorting machine 1 or even be adjacent to or follow the output represented by column "1".

The same also applies to the rows and other columns in the FIG. 2 matrix. The progressive numeration of the rows and columns is therefore a "logical" numeration, to which a "physical" numeration (or arrangement) of the outputs corresponds on the basis of a predetermined relationship memorized in electronic control unit 22 and used in the sorting process to direct the mail items to the required output.

In the following description, therefore, the term "logically adjacent outputs" is intended to mean outputs of sorting machine 1 represented by rows or columns with successive identification numbers, even though the outputs may not be physically adjacent, and the positions of the outputs with respect to each other may bear no relationship to the respective row or column numbers.

Moreover, for the sake of convenience in the following description, given the biunivocal relationships between the outputs of sorting machine 1 and the matrix columns in the current sorting cycle, and between the outputs of sorting machine 1 and the matrix rows in the preceding sorting cycle, the terms "outputs of sorting machine 1" and "rows and columns in the FIG. 2 matrix" will be used indifferently in the two sorting cycles.

Going back to the FIG. 2 matrix, the boxes (elements) in the matrix also assume precise meanings related to the delivery locations or destinations of the mail items. In particular, each box in the matrix defines a respective virtual matrix location to which a real address of a mail item delivery location may be assigned.

Since the boxes in the matrix, as is known, are identified univocally by respective pairs of numbers indicating the respective rows and columns of the boxes, each virtual location to which a delivery location is assignable may therefore be represented by the pair of numbers indicating the row and column of the respective box.

Moreover, given the biunivocal relationships between the rows and columns in the matrix and the outputs of sorting machine 1 in the current sorting cycle and logically preceding sorting cycle, each pair of numbers indicating the column and row of a respective virtual location also represents the output of sorting machine 1 which may be occupied, during the current sorting cycle and at the end of the logically preceding sorting cycle, by mail items bearing delivery locations related to that particular virtual location.

The electronic table memorized in electronic unit 22, and which provides for determining the output to which each mail item is to be directed on the basis of the code data on the mail item, therefore defines a dual univocal relationship between all the possible codes impressed on mail items 2 (and, as stated, identifying respective delivery locations of mail items 2) and corresponding virtual matrix locations related to the coded delivery locations and each identified by a pair of numbers indicating the row and column of a respective box in the matrix.

The rules governing the way in which the delivery locations are sorted at the outputs of sorting machine 1 at the end of the current sorting cycle and the logically preceding sorting cycle are derived from the matrix, by respectively assigning to a delivery location related to a given box in the matrix the output of sorting machine 1 corresponding to the row number of the box in the logically preceding sorting cycle, and the output of sorting machine 1 corresponding to the column number of the box in the current sorting cycle.

More specifically, in the course of each sorting cycle, once the code on each mail item is identified, the virtual location relating to the code and the pair of row and column numbers defining the virtual location are determined, and the virtual location is used by sorting machine 1 to generate, via said table, control signals for controlling actuating members, such as blade selectors, transmission members, etc. (not shown), by which to define a path T along which to feed mail item 2 through sorting device 16 to the selected output Ui.

Since the mail items in each output of sorting machine 1 at the end of the current sorting cycle are arranged in a predetermined order enabling sequential distribution by a mailman assigned to a predetermined delivery route, and since the distribution order is defined, for example, by a sequence of adjacent delivery locations corresponding to building numbers or groups of building numbers along the delivery route, the relationship between all the possible codes on mail items 2 and the corresponding virtual locations defined by said table is such as to define an assignment criterion by which to assign the delivery locations to the respective outputs of sorting machine 1 in conformance with said distribution order of mail items 2.

More specifically, the relationship defined by the table assigns the delivery locations to the boxes in the matrix in ascending column and row order as described below.

The delivery locations are assigned starting with the box in the first row of the first column in the matrix (the top box in the first column) down to the box in the last row of the f first column (bottom box in the first column), then starting from the box in the first row of the second column, down to the box in the last row of the second column, and so on for each successive column.

The way in which the delivery locations are assigned to the virtual locations (i.e. to the boxes in the matrix) therefore binds each box in the FIG. 2 matrix to prevent any switch in position of the delivery locations assigned to boxes in the same column.

With reference to FIG. 2, the boxes in the matrix contain 0 or 1 values indicating the operating state assumed at the boxes by the outputs of sorting machine 1 in the current sorting cycle and logically preceding sorting cycle.

A "1" value indicates the box may be assigned a delivery location, and a "0" value that the box may not be assigned a delivery location.

For the sake of simplicity, therefore, in the following description, a box containing a 1 value will be referred to as an "addressable" box, and one containing a 0 value as a "non-addressable box".

Given the relationship between the rows and columns in the FIG. 2 matrix and the outputs of sorting machine 1 in the current sorting cycle and logically preceding sorting cycle, the presence of a non-addressable box results, in the current sorting cycle, in no mail items being fed into the sorting machine output corresponding to the column containing the non-addressable box for as long as it takes to sort all the mail items in the sorting machine output corresponding to the row containing the non-addressable box.

The presence of a non-addressable box in a matrix row, in fact, indicates that no mail item contained, at the end of the logically preceding sorting cycle, in the sorting machine output corresponding to that row is to be fed, in the current sorting cycle, into the sorting machine output corresponding to the column containing the non-addressable box.

Since performance of the current sorting cycle involves reinserting into input I of the sorting machine all the mail items contained, at the logically preceding sorting cycle, in the sorting machine output corresponding to the row containing the non-addressable box, no mail items will therefore be fed into the output corresponding to the column containing the non-addressable box for as long as it takes to reinsert the mail items.

The object of the planning procedure for clearing the outputs of sorting machine 1 according to the present invention is therefore to define the number and locations of the non-addressable matrix boxes to which delivery locations cannot be assigned, so that the current sorting cycle contains time intervals in which no mail items are fed into the sorting machine outputs corresponding to the columns containing the on-addressable boxes, and the outputs may thus be cleared by a clearing resource during said time intervals.

Each addressable box in the FIG. 2 matrix, i.e. each box to which a delivery location is assignable, may be assigned a numeric value having a particular meaning relating to mail item traffic. In particular, each numeric value may be related to the expected number of mail items to be delivered to the delivery location assigned to the addressable box to which the numeric value is assigned.

The numeric value assigned to a box may indicate the number of mail items in absolute or exact terms or in terms of expected traffic.

The sum of the numeric values assigned to the boxes in each row and each column is assigned a precise meaning related to the load (i.e. the expected number of mail items) in the output of sorting machine 1 corresponding to that particular row or column. More specifically, the sum of the numeric values assigned to the boxes in each row represents the load present at the output of sorting machine 1 corresponding to that particular row at the end of the sorting cycle logically preceding the current sorting cycle; and the sum of the numeric values assigned to the boxes in each column represents the load present at the output of sorting machine 1 corresponding to that particular column at the end of the current sorting cycle.

Each row in the matrix may theoretically be assigned a so-called recycle time in which to recycle the mail items in the output corresponding to that particular row at the end of the logically preceding sorting cycle, i.e. to feed back into the sorting machine and again sort into the machine outputs all the mail items in the output corresponding to that row.

From the recycle times, it is possible to calculate a number of numeric values, one for each sorting machine output, and each equal to the sum of the recycle time of the respective sorting machine output and the recycle times of all the logically preceding outputs, be they statistical or previously determined values.

Due to the way in which they are calculated, the numeric values increase progressively, and may represent discrete values of a time quantity which progresses as the mail items in each sorting machine output at the end of the sorting cycle logically preceding the current sorting cycle are gradually fed back into the sorting machine to perform the current sorting cycle.

In other words, working along the rows of the FIG. 2 matrix, from row 1 to row 50, and by progressively adding the recycle times theoretically assignable to the rows, it is possible to define discrete values of a time quantity which increases as the row identification numbers get higher, and the value of which, at each row, equals the sum of the recycle time of the row and the recycle times of the logically preceding rows.

As explained in more detail later on, the time progression in which the mail items are recycled is a parameter governing determination of the number and location of non-addressable boxes in the FIG. 2 matrix to enable the sorting machine outputs to be cleared by a clearing resource.

One non-addressable box pattern is shown by way of example in the FIG. 2 matrix, in which the non-addressable boxes define an intermediate disabling band, in which all the sorting machine outputs substantially in the intermediate portion of the current sorting cycle may be cleared; and two lateral—respectively start and end—disabling bands located above and below the intermediate disabling band, and in which only some of the sorting machine outputs can be cleared at the initial and final portion respectively of the current sorting cycle, as explained in detail below.

More specifically, the intermediate disabling band is in the form of a sloping elongated strip extending from column 1 to column 50 and located at the intermediate rows in the matrix.

The thickness and slope of the intermediate disabling band have particular meanings related to the clearing operations.

More specifically, the thickness of the intermediate disabling band, which may be defined as the number of non-addressable boxes in the same column, is related to the time taken to clear an output of the sorting machine, and to the time which may be lost due to technical problems.

Throughout the time a clearing resource is engaged in clearing an output on the sorting machine, in fact, no mail items, obviously, must be fed into the output, so that the number of non-addressable boxes in the column corresponding to the output must be such as to enable the output to be cleared.

The intermediate disabling band also slopes towards rows and columns with progressively increasing identification numbers, and the slope of the intermediate disabling band is related to the time progression, defined above, in which the mail items are fed back into the sorting machine and sorted into the machine outputs.

This is due to the number of clearing resources being finite, and to each clearing resource having a finite clearing capacity, so that the time progression in which the outputs are cleared results in the intermediate disabling band "sliding" progressively towards rows and columns with progressively increasing identification numbers.

As stated above, throughout the time a clearing resource is engaged in clearing an output on the sorting machine, no mail items, obviously, must be fed into the output. Nevertheless, within reservable margins of safety, mail items may still be fed into the logically next output right up to shortly before the resource completes clearing the current output and moves on to clear the logically next output.

This progressive shift by the clearing resource from output 1 to output 50, in fact, determines the slope of the intermediate disabling band, which slope is related to the time taken to clear an output, and to the time progression in which the mail items are recycled.

The start disabling band is located in the top-right corner of the FIG. 2 matrix, i.e. covers the initial rows (1–11) and substantially the second half of the columns (19–50) in the matrix, and enables a first group of sorting machine outputs corresponding to said columns to be cleared in the initial portion of the current sorting cycle.

More specifically, the start disabling band is substantially triangular in shape, the oblique side of which originates at a substantially intermediate column (19) in the matrix, slopes towards rows and columns with progressively increasing identification numbers, and has the same slope as the intermediate disabling band.

The end disabling band is located in the bottom-left corner of the FIG. 2 matrix, i.e. covers the final rows (40–50) and substantially the first half of the columns (1–31) in the matrix, and enables a second group of sorting machine outputs corresponding to said columns to be cleared in the final portion of the current sorting cycle.

More specifically, the end disabling band is substantially triangular in shape, the oblique side of which terminates at a substantially intermediate column (31) in the matrix, and has the same slope as the oblique side of the start disabling band and the intermediate disabling band.

The start and end bands enable overlapping of the current sorting cycle and the chronologically preceding and chronologically next sorting cycle respectively.

In other words, the start disabling band permits clearing, at the initial portion of the current sorting cycle (i.e. rows with low identification numbers), of roughly the second half of the sorting machine outputs still containing the mail items sorted in the chronologically preceding sorting cycle; and the end disabling band permits clearing, at the final portion of the current sorting cycle (i.e. rows with high identification numbers), of the remaining first half of the sorting machine outputs still containing mail items sorted in the chronologically preceding sorting cycle.

For example, in the case of the current sorting cycle and chronologically next sorting cycle, each of which is represented by a matrix of the FIG. 2 type, a clearing resource may begin clearing roughly a first half of the sorting machine outputs at the final portion of the current sorting cycle, and continue clearing the remaining second half of the sorting machine outputs at the initial portion of the chronologically next sorting cycle.

As such, the current sorting cycle and clearing of the outputs relative to the chronologically preceding sorting cycle may be overlapped, with no interruption in the sorting process; and it is no longer necessary to wait for the end of one sorting cycle to clear the sorting machine outputs before commencing the next sorting cycle.

The substantially triangular shape of the start and end disabling bands is therefore to enable overlapping of the current sorting cycle and the clearing operations required before and after.

More specifically, the shape and area of the start and end disabling bands are such that, when two matrixes of the FIG. 2 type are brought together vertically, a disabling band is formed which, at the central columns of the matrix, should conveniently be of at least the same thickness as the intermediate disabling band, so as to enable the clearing resource to begin clearing the outputs corresponding to the central columns at the current sorting cycle, and to complete clearing the outputs at the chronologically next sorting cycle.

Since the sorting machine outputs cleared at the start and end bands in the current sorting cycle can obviously receive no further mail items in the course of the current sorting cycle, the start and end bands must necessarily assume the substantially triangular shape shown in FIG. 2.

That is, working away from the central columns in the matrix, the thickness of the start and end bands must not only be such as to enable the outputs to be cleared, bust must also so extend along the columns as to ensure no further mail items are fed into the cleared outputs.

For this reason, the thickness of the start and end disabling bands increases away from the central columns in the FIG. 2 matrix, so that, once cleared by the clearing resource, the outputs receive no further mail items in the course of the same sorting cycle.

The object of the clearing planning procedure-described below with reference to the flow chart in FIGS. 4*a*–4*d*—is therefore to determine the parameters by which to define the shape and number of intermediate disabling bands, and the shape of the start and end disabling bands.

As shown in FIGS. 4*a*–4*d,* to begin with, a block 100 acquires a number of parameters relative to the characteristics of the mail batch for processing, the sorting machine used, mail item feed, and the clearing operations.

In particular, block 100 acquires:

- the expected total traffic T of mail items, which may be determined on the basis of either historic or available real data;
- the number of delivery locations D of the mail batch;
- the number of sorting machine outputs NU assigned to process the mail batch;
- the capacity CU of each output, i.e. the maximum number of mail items each sorting machine output can contain;
- mail item feed rate THR in items/hour, i.e. the number of items fed per hour to the sorting machine input;
- the average clearing time ASW of each sorting machine output;
- the permitted clearing delay SWD of each sorting machine output, which defines a clearing resource safety margin over and above the normal clearing time of the resource; and
- a start/end clearing parameter FSF, which assumes a first value, e.g. 0, if start and end clearing (i.e. start and end disabling bands) are not required, and a second value other than the first, e.g. 1, if start and end clearing are required.

Block 100 is followed by a block 110, which calculates the values of a first series of parameters relating to processing of the mail batch, and by which to define the intermediate disabling band and the start and end disabling bands.

In particular, block 110 calculates:

- average traffic per delivery location DNS—i.e. the average number of mail items to be distributed to each delivery location—according to the equation:

$$DNS=T/D$$

total capacity CAP of the sorting machine, according to the equation:

$$CAP=NU*CU$$

total processing time FT of the mail batch, according to the equation:

$$FT=3600*T/THR$$

duration of each clearing cycle SWC to clear the sorting machine outputs, according to the equation:

$$SWC=ASW*NU$$

the effect PSF of the duration of each clearing cycle on the total processing time of the mail batch, according to the equation:

$$PSF=SWC/FT$$

Block 110 is followed by a block 120, which acquires the percentage XAD of matrix boxes to be kept free with respect to the number of delivery locations D in the mail batch.

Block 120 is followed by a block 130, which calculates the values of a second series of parameters relating to processing of the mail batch, and by which to define the disabling bands.

In particular, block 130 calculates:

the number of boxes NCAS in the matrix, which is calculated by multiplying the number of rows by the number of columns in the matrix and, since the matrix is square in the example shown, according to the equation:

$$NCA=NU\hat{0}2$$

average traffic density per box DNC, according to the equation:

$$DNC=T/NCAS$$

average traffic density per row DNR, according to the equation:

$$DNR=DNC*NU$$

equivalent feed time per row FTR—i.e. the time taken to feed back into the input of the sorting machine all the mail items contained in a sorting machine output at the end of the sorting cycle logically preceding the current sorting cycle—according to the equation:

$$FTR=3600*DNR/THR$$

box occupancy rate OCC—i.e. how many addressable boxes in the matrix will be occupied by delivery locations—according to the equation:

$$OCC=D/NCAS$$

permitted maximum-occupancy rate of the disabling bands POC—i.e. the number, expressed as a percentage, of matrix boxes which may be considered non-addressable, that is, the number available to define the intermediate disabling band and the start and end disabling bands—according to the equation:

$$POC=1-OCC*(1+XAD)$$

maximum number of non-addressable boxes NPR, according to the equation:

$$NPR=POC*NCAS$$

Block 130 is followed by a block 140, which calculates the minimum number of intermediate clearing operations (intermediate disabling bands) NSWmin required on the basis of total traffic T of the mail batch and the total capacity CAP of the sorting machine, according to the equation:

$$NSW\min=INT(T/CAP)$$

where INT is the mathematical operator which gives the whole value of the quantity operated on.

Block 140 is followed by a block 150, which calculates the maximum number of intermediate clearing operations NSWFmax which can be performed without exceeding feed rate THR, according to the equation:

$$NSWF\max=(FT/ASW)-FSF$$

Block 150 is followed by a block 160, which determines whether the maximum number of intermediate clearing operations NSWFmax is greater than or equal to 1.

If NSWFmax is greater than or equal to 1 (YES output of block 160), block 160 goes on to a block 180; conversely, if NSWFmax is less than 1 (NO output of block 160), block 160 goes on to a block 170 in which NSWFmax is made equal to 0, by the feed characteristics indicating no need for intermediate clearing operations.

Block 170 is followed by block 180 which acquires the maximum number of user-permitted intermediate clearing operations NSWUmax, and the user-selected number of intermediate clearing operations NSW.

Block 180 is followed by a block 190 which determines whether the user-selected number of intermediate clearing operations NSW falls within an acceptance range defined by NSWFmax and NSWUmax, and in particular whether NSW is less than NSWmin or greater than the lesser of NSWFmax and NSWUmax, i.e. whether:

$$NSW\min \leqq NSW \leqq \mathrm{MIN}(NSWF\max, NSWU\max)$$

If NSW falls within said acceptance range (YES output of block 190), block 190 goes on to a block 210; conversely, if NSW is outside said acceptance range (NO output of block 190), block 190 goes on to a block 200 which indicates the planning procedure cannot be performed and why. The planning procedure is then terminated.

Block 210, on the other hand, calculates:

total clearing time TST of the sorting machine outputs (equal to the sum of the clearing times in each disabling band) according to the equation:

$$TST=(NSW+FSF)*SWC$$

the effect PSWF of total clearing time TST on total processing time FT, according to the equation:

$$PSWF=TST/FT$$

Block 210 is followed by a block 220, which calculates the maximum total thickness SBTTmax of the intermediate disabling band and the start and end disabling bands, on the basis of the condition that total clearing time TST not be greater than total processing time FT, according to the equation:

$$SBTT\max=INT((1-PSWF)*NU+(NSW+FSF)*ASW/FTR)$$

Block 220 is followed by a block 230, which calculates the maximum total thickness SBADmax of the intermediate disabling band and the start and end disabling bands on the basis of matrix box occupancy and taking into account the percentage XAD of matrix boxes to be kept free with respect to the number of delivery locations D in the mail batch. More specifically, maximum total thickness SBADmax is calculated according to the equation:

$$SBAD\max=POC*NU$$

Block 230 is followed by a block 240, which calculates the maximum total thickness of the bands SBmax on the basis of the SBTTmax and SBADmax values, and in particular as the lesser of values SBTTmax and SBADmax, i.e.

$$SB\max=\mathrm{MIN}(SBTT\max,\ SBAD\max)$$

Block 240 is followed by a block 250, which calculates the thickness of each band SB on the basis of the average clearing time of each output ASW and taking into account the permitted clearing delay SWD of each output. More specifically, the thickness of an intermediate disabling band SB is calculated according to the equation:

$$SB=INTSUP((ASW+SWD)/FTR)$$

where INTSUP is the mathematical operator which gives the upper integer of the quantity operated on.

Block 250 is followed by a block 260 which determines whether the intermediate disabling band thickness SB and the user-selected number of clearing operations NSW meet the maximum total disabling band thickness SBmax requirement, and in particular whether:

$$SB*(NSW+FSF)<SB\max$$

If the maximum total disabling band thickness SBmax requirement is met (YES output of block 260), block 260 goes on to a block 280; conversely, if the maximum total disabling band thickness SBmax requirement is not met (NO output of block 260), block 260 goes on to a block 270 which indicates the planning procedure cannot be performed and why. The planning procedure is then terminated.

Block 280, on the other hand, calculates the parameters by which to define the intermediate disabling band and the start and end disabling bands, and which are calculated by means of straightforward geometric considerations relative to the matrix.

In particular, block 280 calculates:

band slope SK, expressed in number of columns/rows, according to the equation:

$$SK=FTR/ASW$$

the height HB of an intermediate disabling band—expressed in boxes and representing the total number of rows in the intermediate disabling band, i.e. the total number of rows comprising at least one non-addressable box—according to the equation:

$$HB=SB+NU/SK$$

the height HS of a start and end disabling band, expressed in boxes, according to the equation:

$$HS=HB/2$$

the total height THB of the intermediate disabling bands and the start and end disabling bands, according to the equation:

$$THB=HS+(HB+FSF)*NSW$$

the total height HTPF of feed-only bands—expressed in boxes and representing the number of rows outside the intermediate disabling bands and start and end disabling bands, i.e. the total number of rows comprising no non-addressable boxes (horizontal strips comprising only addressable boxes and where only sorting operations are performed)—according to the equation:

$$HTPF=NU-THB$$

the height HPF of a feed-only band, expressed in boxes, according to the equation:

$$HPF=HTPF/(FSF+NSW)$$

Figure 3:
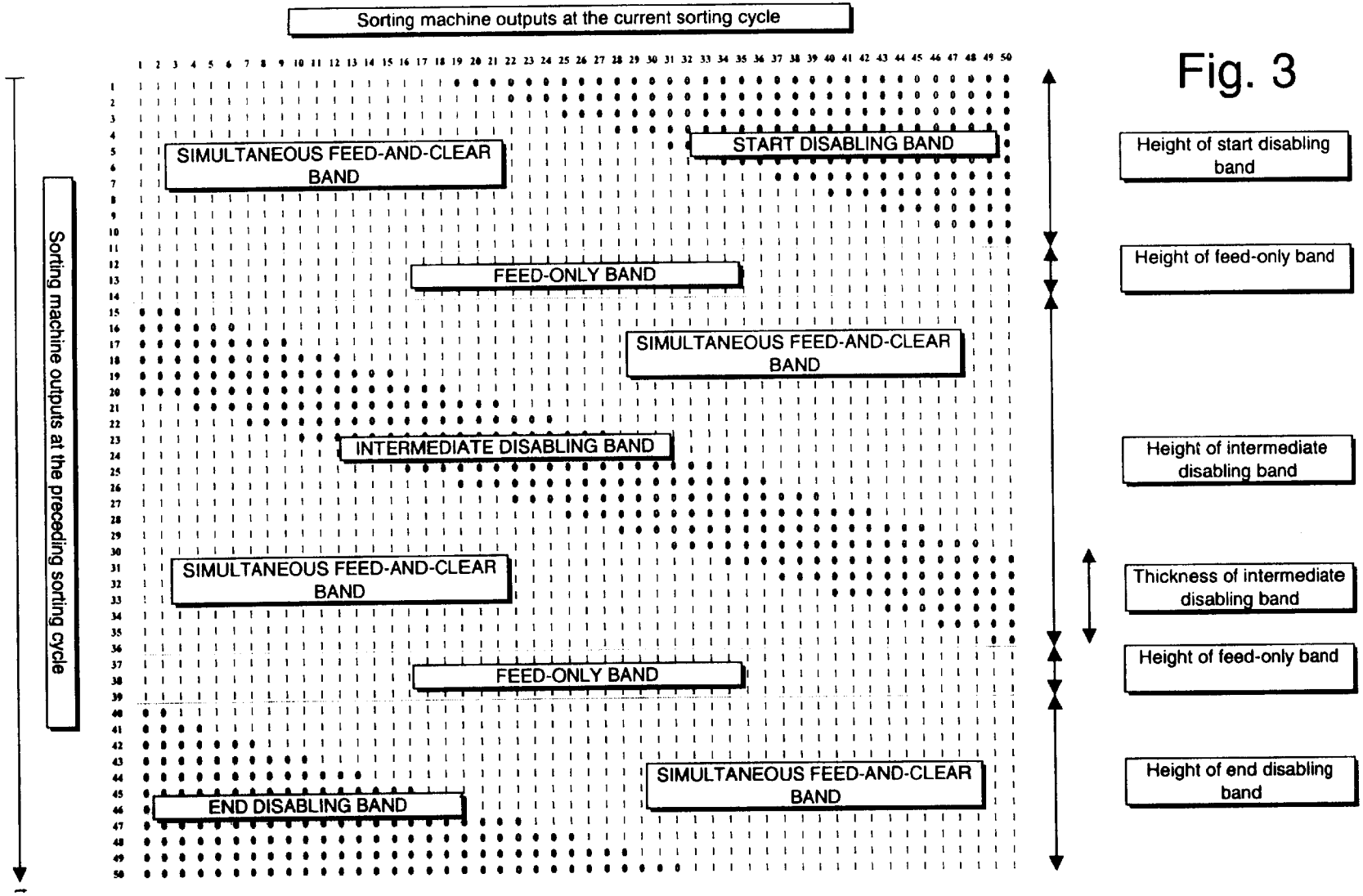
Figure 4A:
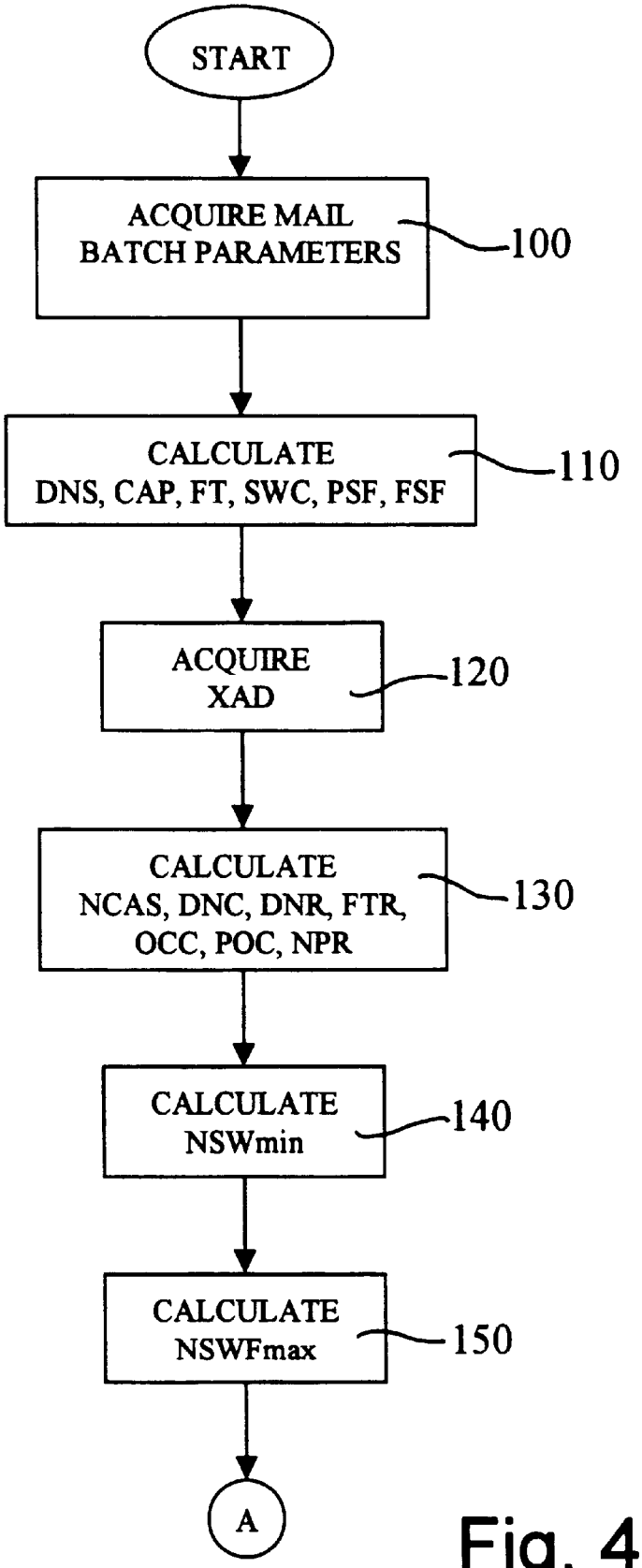
FIGS. 4*a*–4*d* show a flow chart of the planning procedure according to the present invention.
Figure 4B:
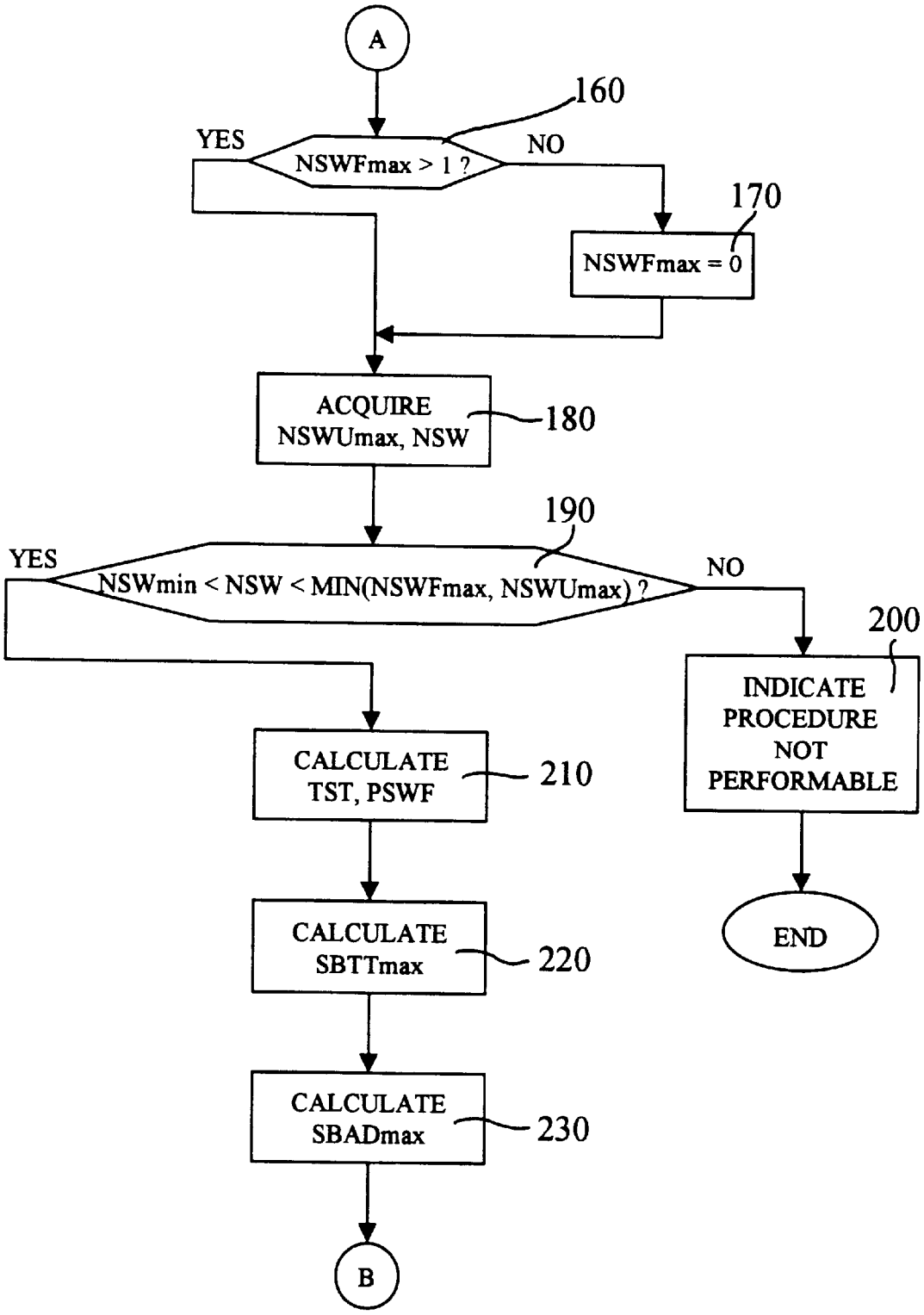
Figure 4C:
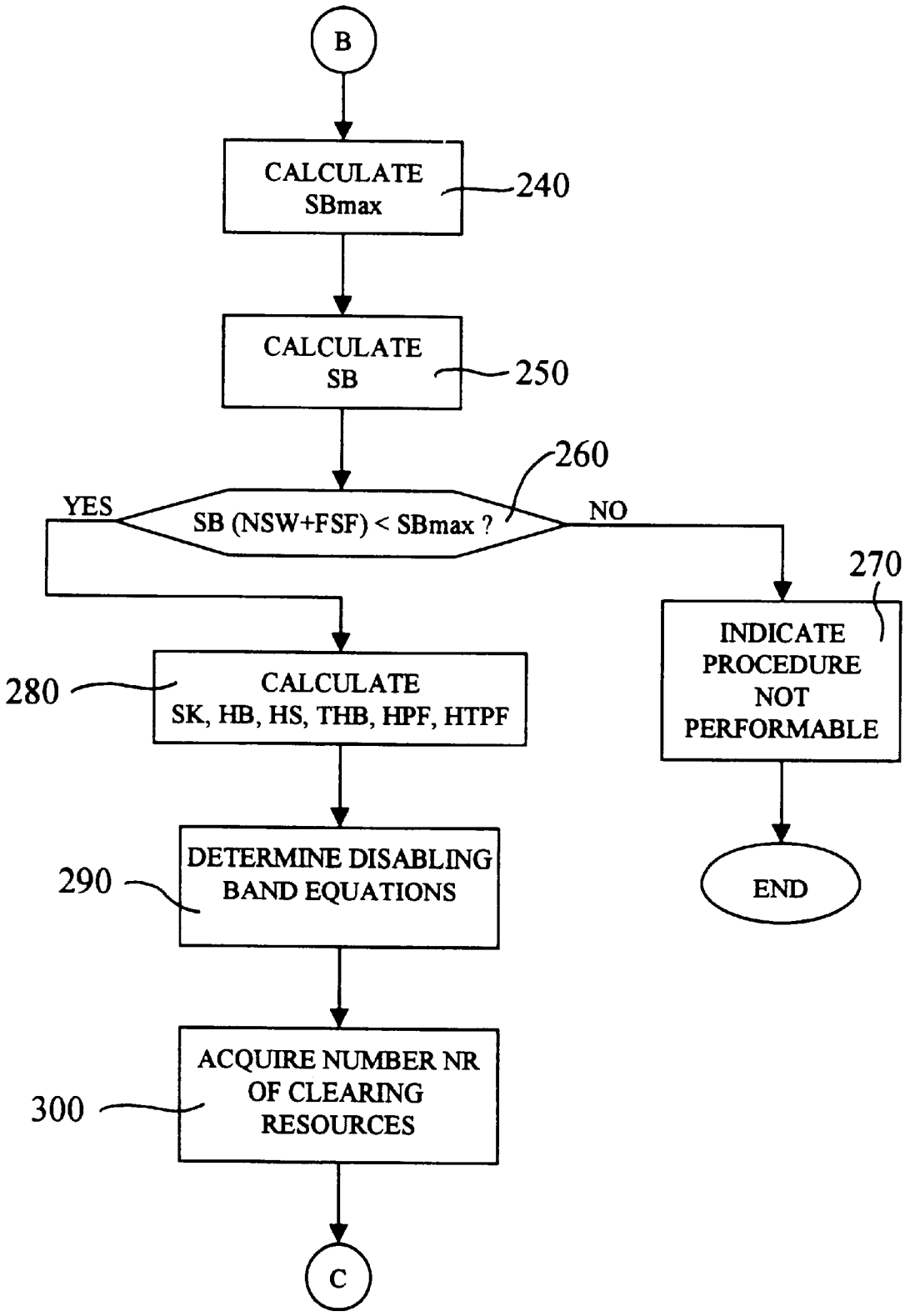
Figure 4D:
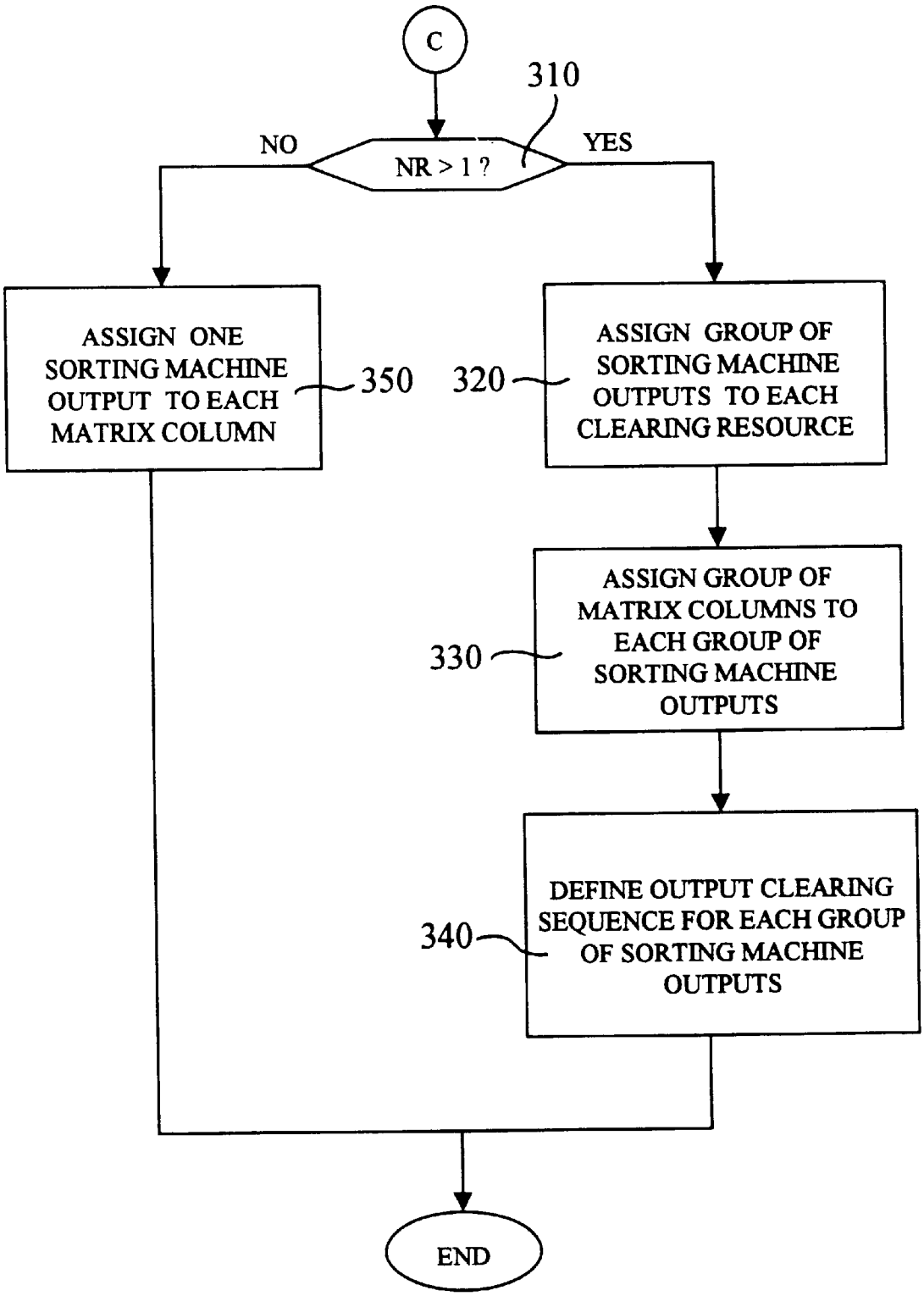

FIG. 3 shows the FIG. 2 matrix illustrating the intermediate disabling band, the start and end bands, the feed-only bands, simultaneous feed-and-clear bands, and the respective heights.

Block 280 is followed by a block 290 which, on the basis of the parameters calculated above, determines the equations of the intermediate disabling band and the lateral disabling bands.

More specifically, using indices i and j to indicate the boxes in the matrix rows and columns respectively, and by means of straightforward geometric considerations, it is possible to determine the equation of the k-th intermediate disabling band:

$$\begin{cases} (k-1)\cdot(HB+HPF)+INT\left(P1+\dfrac{j}{SK}\right)\le i\le(k-1)\cdot(HB+HPF)+INT\left(SB+P1+\dfrac{j}{SK}\right) \\ 1\le j\le NU \\ 1\le k\le NSW \\ P1=INT\left(\dfrac{NU}{2\cdot SK}\right)+HPF+\dfrac{SB}{2} \end{cases}$$

the equation of the start disabling band:

$$\begin{cases} 1\le i\le INT\left[j-\dfrac{1}{2}\cdot(NU-SB\cdot SK)\right]\cdot\dfrac{1}{SK} \\ \dfrac{1}{2}\cdot(NU-SB\cdot SK)\le j\le NU \end{cases}$$

and the equation of the end disabling band:

$$\begin{cases} INT\left[j - \frac{1}{2}\cdot(NU + SB\cdot SK)\cdot\frac{1}{SK} + NU\right] \le i \le NU \\ 1 \le j \le \frac{1}{2}\cdot(NU + SB\cdot SK) \end{cases}$$

Block 290 is followed by a block 300 which acquires the number of clearing resources NR available to clear the sorting machine outputs.

Block 300 is followed by a block 310 which determines whether the number of clearing resources NR is greater than one.

If the number of clearing resources is greater than one (YES output of block 310), block 310 goes on to a block 320; conversely, if the number of clearing resources equals one (NO output of block 310), block 310 goes on to a block 350.

In block 320, each clearing resource is assigned a respective group of sorting machine outputs; and the outputs in each group are so selected as to provide for efficient clearing by the respective clearing resource.

Block 320 is followed by a block 330 in which each group of sorting machine outputs is assigned a respective group of matrix columns according to a first assignment criterion.

The assignments in blocks 320 and 330 therefore result in each clearing resource being assigned a respective submatrix of the FIG. 2 matrix, which submatrix has the same number of rows as the FIG. 2 matrix, but a smaller number of columns equal to the number of sorting machine outputs assigned to the clearing resource.

In particular, each submatrix "looks" the same as the FIG. 2 matrix, i.e. has a start disabling band, an end disabling band, and one or more intermediate disabling bands as shown in FIG. 2.

In general, therefore, the above assignments do not alter the number or overall shape of the disabling bands, but only the slope, which is greater.

For example, if two clearing resources are available, a first may be assigned a first group of outputs defined by the first half of the sorting machine outputs, and the second may be assigned a second group of outputs defined by the second half of the sorting machine outputs. At this point, the first group of outputs may be assigned the even-numbered columns in the FIG. 2 matrix, and the second group of outputs may be assigned the odd-numbered columns in the FIG. 2 matrix.

Block 330 is followed by a block 340 which, for each group of sorting machine outputs assigned to each clearing resource, defines an output clearing sequence designed to ensure efficient clearing by the respective clearing resource.

In block 350, on the other hand, which is accessed when only one clearing resource is available, each sorting machine output is assigned a respective matrix column according to an assignment order.

For example, according to the assignment order, the physical numbers of the sorting machine outputs may correspond perfectly to the identification numbers of the columns in the matrix.

Upon completion of the operation in block 340 or 350, the planning procedure is terminated, and is followed by known procedures for assigning delivery locations to the available FIG. 2 matrix boxes, and determining tables—one for each sorting cycle— relating each delivery location to a respective sorting machine output into which the mail items relating to that particular delivery location are to be fed in the course of the sorting cycle.

The advantages of the clearing planning procedure according to the present invention will be clear from the foregoing description.

In particular, the clearing planning procedure according to the invention provides for considerable saving in time and resources by dissociating the clearing and sorting operations at the outputs, so that not only may one or more intermediate clearing operations of the sorting machine outputs be performed in the course of a sorting cycle, with no interruption in the sorting process, but clearing of the outputs may also be commenced at the final portion of the sorting cycle and continued at the initial portion of the chronologically next sorting cycle. As such, the current sorting cycle and clearing of the outputs relative to the chronologically preceding sorting cycle may be overlapped; and it is no longer necessary to wait for the end of one sorting cycle to clear the sorting machine outputs before commencing the next sorting cycle.

Clearly, changes may be made to the planning procedure as described and illustrated herein without, however, departing from the scope of the present invention.

For example, the non-addressable box pattern in the FIG. 2 matrix may be other than as shown.

In particular, if overlapping of the current sorting cycle and the chronologically preceding and/or chronologically next sorting cycle is not required, the start and/or end disabling band may be dispensed with, and only the intermediate disabling band provided to enable clearing of all the sorting machine outputs at the intermediate portion of the current sorting cycle.

In the event of high mail item traffic or a sorting machine with low-capacity outputs, the FIG. 2 matrix may comprise two or more spaced, parallel intermediate disabling bands—with or without start and end disabling bands—each enabling all the sorting machine outputs to be cleared in what, in this case, may be considered the intermediate portion of the current sorting cycle.

The number of boxes in the start and end disabling bands may be other than as shown.

In particular, while remaining triangular in shape, the start and end disabling bands may be larger or smaller in area, with the oblique sides originating or terminating at columns other than those shown.

Whatever the area of the triangles, the start disabling band is always located at the initial rows and at columns comprising at least the final columns in the matrix; and the end disabling band is always located at the final rows and at columns comprising at least the initial columns in the matrix.

The areas of the start and end disabling bands should, however, be such that, when two matrixes of the FIG. 2 type are brought together vertically, a disabling band is formed which, at any point, should conveniently be of at least the same thickness as the intermediate disabling band, so as to enable the clearing resource to begin clearing the outputs corresponding to the central columns at the current sorting cycle, and to complete clearing the outputs at the chronologically next sorting cycle.

What is claimed is:

1. A method for clearing mail sorting outputs of a mail sorting machine concurrently with a current sorting cycle of a mail sorting process having a first and at least a second logically consecutive sorting cycle, said method comprising:

receiving a batch of mail items at an input of the mail sorting machine;

supplying the mail items, identified and separated according to given sorting rules, to outputs of the mail sorting machine;

feeding the mail items, fed to the outputs of the mail sorting machine on the basis of a respective predetermined sorting criterion, back to the input of the mail sorting machine in an orderly manner to perform a successive sorting cycle;

indicating time intervals in which the outputs of the mail sorting machine are unavailable;

feeding no mail items to each output of the mail sorting machine that has been indicated as being unavailable; and clearing the outputs that have been indicated as being unavailable during the time interval while mail is fed to available outputs to be sorted.

2. A method for clearing mail sorting outputs of a mail sorting machine concurrently with a current sorting cycle of a mail sorting process having a first and at least a second logically consecutive sorting cycle, said method comprising:

receiving a batch of mail items at an input of the mail sorting machine;

supplying the mail items, identified and separated according to given sorting rules, to outputs of the mail sorting machine;

feeding the mail items, fed to the outputs of the mail sorting machine on the basis of a respective predetermined sorting criterion, back to the input of the mail sorting machine in an orderly manner to perform a successive sorting cycle;

assigning, at each sorting cycle, each output of the mail sorting machine a number of respective delivery locations to which the mail items are to be delivered;

indicating time intervals in which the outputs have operating states that render the outputs available or unavailable, wherein the operating states of the outputs and the time intervals are represented by a matrix of elements in which each column represents outputs of the mail sorting machine in the current sorting cycle, and each row represents the outputs of the mail sorting machine in a logically preceding sorting cycle;

assigning each element in the matrix a respective said delivery location, wherein the column and row of each element represents the outputs of the mail sorting machine occupied by the mail items bearing the delivery locations assigned to the element, at the end of the current sorting cycle and the logically preceding sorting cycle respectively;

defining, in the matrix, non-addressable elements to which delivery locations cannot be assigned, so that the current sorting cycle contains time intervals in which no mail items are fed to the outputs of the mail sorting machine corresponding to the columns containing said non-addressable elements; and clearing the outputs corresponding to the non-addressable elements by a clearing resource during the time intervals.

3. The method according to claim 2, wherein the step of defining non-addressable elements in the matrix comprises defining, in the matrix, a start disabling band of non-addressable elements to enable a first group of outputs of the mail sorting machine to be cleared at an initial portion of the current sorting cycle.

4. The method according to claim 3, wherein the start disabling band is located at a first set of rows of the matrix and comprises at least the initial rows of the matrix and at least the final columns of the matrix.

5. The method according to claim 4, wherein the start disabling band is substantially triangular in shape, with an oblique side sloping towards rows and columns having progressively increasing identification numbers.

6. The method according to claim 5, wherein the start disabling is substantially triangular in shape, with an oblique side having a slope related to a time progression in which the mail items are fed back into the mail sorting machine and fed to the outputs of the mail sorting machine in the course of the current sorting cycle.

7. The method according to claim 2, wherein the step of defining non-addressable elements in the matrix comprises defining, in the matrix, an end disabling band of non-addressable elements to enable a second group of outputs of the mail sorting machine to be cleared at the final portion of the current sorting cycle.

8. The method according to claim 7, wherein the end disabling band is located at a second set of rows of the matrix and comprises at least the final rows of the matrix and at least the initial columns of the matrix.

9. The method according to claim 8, wherein the end disabling band is substantially triangular in shape, with an oblique side sloping towards rows and columns having progressively increasing identification numbers.

10. The method according to claim 9, wherein the end disabling is substantially triangular in shape, with an oblique side having a slope related to a time progression in which the mail items are fed back into the mail sorting machine and fed to the outputs of the mail sorting machine in the course of the current sorting cycle.

11. The method according to claim 2, wherein the step of defining non-addressable elements in the matrix comprises defining, in the matrix, at least one intermediate disabling band of non-addressable elements, such as to enable all outputs of the mail sorting machine to be cleared substantially at the intermediate portion of the current sorting cycle.

12. The method according to claim 11, wherein the step of defining non-addressable elements in the matrix comprises the step of defining, in the matrix, a number of said intermediate disabling bands parallel to and spaced with respect to one another.

13. The method according to claim 11, wherein the intermediate disabling band is located at a third set of rows of the matrix and comprises at least the intermediate rows of the matrix and extends over all columns of the matrix.

14. The method according to claim 13, wherein the intermediate disabling band is in the form of an elongated strip.

15. The method according to claim 2, wherein the intermediate disabling band has a thickness related to the time taken by a clearing resource to clear an output of the mail sorting machine.

16. The method according to claim 14, wherein the intermediate disabling band slopes towards rows and columns having progressively increasing identification numbers.

17. The method according to claim 16 wherein the slope of the intermediate disabling band is related to a time progression in which the mail items are fed back into the mail sorting machine and fed to the outputs of the mail sorting machine in the course of the current sorting cycle.

18. The method according to claim 2, further comprising the steps of:

acquiring a number of clearing resources available to clear the outputs of the mail sorting machine;

performing, in the event said number of clearing resources is greater than one, the steps of:

assigning each clearing resource a respective group of outputs of the mail sorting machine, the outputs in each group being so selected as to ensure efficient clearing by the respective clearing resource;

assigning each group of outputs of the mail sorting machine a respective group of columns of the matrix according to a first assignment criterion; and assigning each output of the mail sorting machine a respective column of the mail sorting machine according to a second assignment criterion, in the event the number of clearing resources equals one.

19. The method according to claim 18, in the event the number of clearing resources is greater than one, further comprising the step of:

defining, for each of the groups of outputs of the mail sorting machine assigned to the clearing resources, a sequence in which to clear the outputs of the mail sorting machine and such as to ensure efficient clearing by the respective clearing resource.

20. A method for clearing mail sorting outputs of a mail sorting machine concurrently with a current sorting cycle of a mail sorting process having a first and at least a second logically consecutive sorting cycle, said method comprising:

receiving a batch of mail items at an input of the mail sorting machine;

supplying the mail items, identified and separated according to given sorting rules, to outputs of the mail sorting machine;

feeding the mail items, fed to the outputs of the mail sorting machine on the basis of a respective predetermined sorting criterion, back to the input of the mail sorting machine in an orderly manner to perform a successive sorting cycle;

assigning, at each sorting cycle, each output of the mail sorting machine a number of respective delivery locations to which the mail items are to be delivered;

indicating time intervals in which the outputs have operating states that render the outputs available or unavailable, wherein the operating states of the outputs and the time intervals are represented by a matrix in which each column represents outputs of the mail sorting machine in the current sorting cycle, and each row represents the outputs of the mail sorting machine in a logically preceding sorting cycle;

assigning each element in the matrix a respective said delivery location, wherein the column and row of each element represents the outputs of the mail sorting machine occupied by the mail items bearing the delivery locations assigned to the element, at the end of the current sorting cycle and the logically preceding sorting cycle respectively;

defining, in the matrix, non-addressable elements to which delivery locations cannot be assigned, so that the current sorting cycle contains time intervals in which no mail items are fed to the outputs of the mail sorting machine corresponding to the columns containing said non-addressable elements;

defining, in the matrix, at least one start disabling band of non-addressable elements, such as to enable a first group of outputs of the mail sorting machine to be cleared at the initial portion of the current sorting cycle;

defining, in the matrix, at least one end disabling band of non-addressable elements, such as to enable a second group of outputs of the mail sorting machine to be cleared at the final portion of the current sorting cycle;

defining, in the matrix, at least one intermediate disabling band of non-addressable elements, such as to enable all outputs of the mail sorting machine to be cleared substantially at the intermediate portion of the current sorting cycle;

acquiring a number of first operating parameters relative to the characteristics of the mail batch for processing, of said mail sorting machine, of the mail item feed operations, and of the clearing operations;

determining, as a function of said first operating parameters, second operating parameters relative to the processing characteristics of the mail batch;

determining a minimum number of necessary intermediate clearing operations NSWmin and a maximum number of intermediate clearing operations NSWFmax performable as a function of the values of said first and second operating parameters;

acquiring a maximum number of user-permitted intermediate clearing operations NSWUmax and a user-selected number of intermediate clearing operations NSW;

determining whether said user-selected number of intermediate clearing operations NSW falls within a predetermined acceptance range; said predetermined acceptance range being a function of said maximum number of user-permitted intermediate clearing operations NSWUmax, of said minimum number of necessary intermediate clearing operations NSWmin, and of said maximum number of intermediate clearing operations NSWFmax; and determining geometric parameters relative to said start, end and intermediate disabling bands as a function of said first and second operating parameters in the event said user-selected number of intermediate clearing operatons NSW falls within said predetermined acceptance range; and clearing the outputs corresponding to the non-addressable elements by a clearing resource during the time intervals.

21. The method according to claim 20, wherein step of acquiring a number of first operating parameters comprises the steps of:

acquiring a total traffic T of the mail batch;

acquiring a number of delivery locations D of the mail batch;

acquiring a number of outputs NU, of the mail sorting machine, assigned to process the mail batch;

acquiring a capacity CU of a single output of the mail sorting machine;

acquiring a feed rate THR of mail items to the input of the mail sorting machine;

acquiring an average clearing time ASW of an output, of the mail sorting machine;

acquiring a delay SWD permitted in the clearing of an output of the mail sorting machine;

acquiring a start/end clearing parameter FSF indicating the presence of the start and end disabling bands; and acquiring a percentage XAD of boxes in the matrix to be kept free with respect to the number of delivery locations D of the mail batch.

22. The method according to claim 21, wherein the step of determining second operating parameters comprises the steps of:

determining a total capacity CAP of the mail sorting machine, according to the equation:

$$CAP=NU*CU;$$

determining a total processing time FT of the mail batch, according to the equation:

$$FT=3600*T/THR;$$

determining a duration of a clearing cycle SWC to clear the outputs of the mail sorting machine, according to the equation:

$$SWC=ASW*NU;$$

determining an effect PSF of the duration of a clearing cycle on the total processing time of the mail batch, according to the equation:

$$PSF=SWC/FT;$$

determining a number of boxes NCAS in the matrix by multiplying the number of rows by the number of columns in the matrix; determining an average traffic density per box DNC, according to the equation:

$$DNC=T/NCAS;$$

determining an average traffic density per row DNR, according to the equation:

$$DNR=DNC*NU;$$

determining an equivalent feed time per row FTR, according to the equation:

$$FTR=3600*DNR/THR;$$

determining a box occupancy rate OCC, according to the equation:

$$OCC=D/NCAS;$$

determining a maximum permitted occupancy rate of the disabling bands POC, according to the equation:

$$POC=1-OCC*(1+XAD);$$

determining a maximum number of non-addressable boxes NPR, according to the equation:

$$NPR=POC*NCAS.$$

23. The method according to claim 22, wherein the step of determining a minimum number of necessary intermediate clearing operations NSWmin and a maximum number of intermediate clearing operations NSWFmax performable comprises the steps of:

determining the minimum number of necessary intermediate clearing operations NSWmin on the basis of said total traffic T of the mail batch, and of the total capacity CAP of the mail sorting machine, according to the equation:

$$NSW\min=INT(T/CAP),$$

where INT is a mathematical operator which gives the whole value of the quantity operated on; and determining said maximum number of intermediate clearing operations NSWFmax performable without exceeding said feed rate THR, according to the equation:

$$NSWF\max=(FT/ASW)-FSF.$$

24. The method according to claim 22, wherein the step of determining a minimum number of necessary intermediate clearing operations NSWmin and a maximum number of intermediate clearing operations NSWFmax performable further comprises the steps of:

comparing the maximum number of intermediate clearing operations NSWFmax with a reference value; and making the maximum number of intermediate clearing operations NSWFmax equal to zero in the event of a first predetermined relationship between the maximum number of intermediate clearing operations NSWFmax and the reference value.

25. The method according to claim 24, wherein the first predetermined relationship is defined by the condition that the maximum number of intermediate clearing operations NSWFmax be greater than or equal the reference value.

26. The method according to 25, wherein the reference value equals 1.

27. The method according to claim 23, wherein step of determining whether the user-selected number of intermediate clearing operations NSW falls within a predetermined acceptance range comprises the step of determining whether:

$$\mathrm{NSWmin} \leqq \mathrm{NSW} \leqq \mathrm{MIN}(\mathrm{NSWFmax}, \mathrm{NSWUmax}).$$

28. The method according to claim 21, wherein the step of determining geometric parameters relative to the start, end and intermediate disabling bands comprises the steps of:

determining a total clearing time TST to clear the outputs of said mail sorting machine, according to the equation:

$$TST=(NSW+FSF)*SWC;$$

determining an effect PSWF of the total clearing time on the total processing time, according to the equation:

$$PSWF=TST/FT;$$

determining a first maximum total thickness SBTTmax of the disabling bands, on the basis of the condition that the total clearing time TST not be greater than the total processing time FT, according to the equation:

$$SBTT\max=INT((1-PSWF)*NU+(NSW+FSF)*ASW/FTR);$$

determining a second maximum total thickness SBADmax of the disabling bands on the basis of matrix box occupancy and taking into account the percentage XAD of matrix boxes to be kept free with respect to the number of delivery locations D of the mail batch, according to the equation:

$$SBAD\max=POC*NU;$$

determining a third maximum total thickness SBmax of the disabling bands, according to the equation:

$$SB\max=\mathrm{MIN}(SBTT\max, SBAD\max);$$

determining a thickness of each disabling band SB, according to the equation:

$$SB=INTSUP((ASW+SWD)/FTR),$$

where INTSUP is a mathematical operator which gives the upper integer of the quantity operated on.

29. The method according to 28, wherein the step of determining geometric parameters relative to the start, end and intermediate disabling bands further comprises the steps of:

determining whether:

$$SB*(NSW+FSF)<Sb\max,$$

and, in the event of a positive response, performing the following operations:

determining a slope SK of the disabling bands, according to the equation:

$$SK=FTR/ASW;$$

determining a height HB of an intermediate disabling band, according to the equation:

$$HB=SB+NU/SK;$$

determining a height HS of a start and end disabling band, according to the equation:

$$HS=HB/2;$$

determining a total height TBB of the intermediate disabling bands and the start and end disabling bands, according to the equation:

$$THB=HS+(HB+FSF)*NSW;$$

determining a total height HTPF of feed-only bands, according to the equation:

$$HTPF=NU-THB;$$

determining a height HPF of a feed-only band, according to the equation:

$$HPF=HTPF/(FSF+NSW).$$

30. The method according to claim 29, wherein the step of defining non-addressable boxes comprises the step of determining an equation of the k-th intermediate disabling band:

$$\begin{cases} (k-1)\cdot(HB+HPF)+INT\left(P1+\frac{j}{SK}\right)\le i\le(k-1)\cdot(HB+HPF)+INT\left(SB+P1+\frac{j}{SK}\right) \\ 1\le j\le NU \\ 1\le k\le NSW \\ P1=INT\left(\frac{NU}{2\cdot SK}\right)+HPF+\frac{SB}{2} \end{cases}$$

of the start disabling band:

$$\begin{cases} 1\le i\le INT\left[j-\frac{1}{2}\cdot(NU-SB\cdot SK)\right]\cdot\frac{1}{SK} \\ \frac{1}{2}\cdot(NU-SB\cdot SK)\le j\le NU \end{cases}$$

and of the end disabling band:

$$\begin{cases} INT\left[j-\frac{1}{2}\cdot(NU+SB\cdot SK)\cdot\frac{1}{SK}+NU\right]\le i\le NU \\ 1\le j\le\frac{1}{2}\cdot(NU+SB\cdot SK) \end{cases}$$

where i and j are indices representing the boxes in the rows and columns respectively of the matrix.

* * * * *